United States Patent [19]

Camardella

[11] 4,380,919

[45] Apr. 26, 1983

[54] COIL WINDING MACHINE

[75] Inventor: Giuseppe Camardella, Saronno, Italy

[73] Assignee: Tekma Kinomat S.p.A., Caronno Pertusella, Italy

[21] Appl. No.: 196,311

[22] Filed: Oct. 14, 1980

[30] Foreign Application Priority Data

Jan. 22, 1980 [IT] Italy ..... 19355 A/80

[51] Int. Cl.[3] ..... B21F 3/04

[52] U.S. Cl. ..... 72/132; 72/138; 72/144

[58] Field of Search ..... 72/132, 138, 143, 144, 72/135, 140, 142

[56] References Cited

U.S. PATENT DOCUMENTS 2,192,260 3/1940 Fisher et al. ..... 72/144

2,439,893 4/1948 Iden ..... 72/144

FOREIGN PATENT DOCUMENTS 623032 7/1961 Italy .

*Primary Examiner*—Lowell A. Larson

*Attorney, Agent, or Firm*—Young & Thompson

[57] ABSTRACT

Coil winding machine for the winding of coils without support, of bare or insulated wire, comprising a main drive shaft, onto which is keyed a set of control cams controlling the movements of:

a spindle, on which the coil is formed and which is caused to rotate by a gearing comprising a sector gear, oscillated by a first cam, and a pinion gear keyed onto the spindle shaft, the pinion and the shaft being movable parallely to themselves along an arc concentric to the rotation axis of an intermediate gearwheel;

a wireguide, for feeding the wire and guiding the distribution of the turns, the forward movement of which is controlled by a second cam and which comprises structures for positively retaining the wire during its forward movement at the start of the winding;

shears for cutting the wire at the end of the winding, which are controlled by a third cam and which can be adjusted with precision in respect of the spindle and the wireguide, so as to determine the length of the terminals at the start and at the end of the winding; and means for determining the turns distribution law, which acts on the wireguide.

36 Claims, 17 Drawing Figures

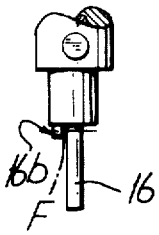
Fig.8a
Fig. 8.
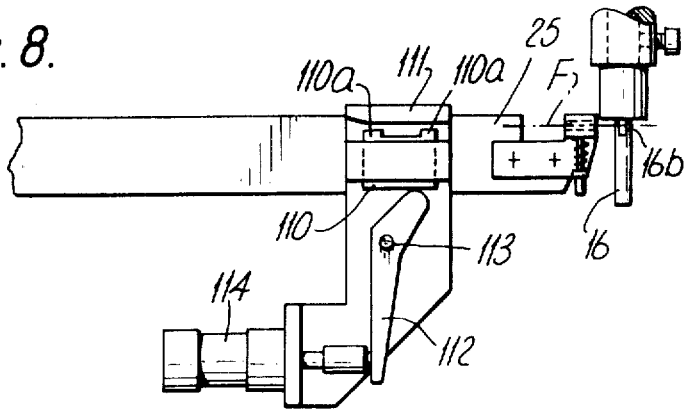
Fig.9.
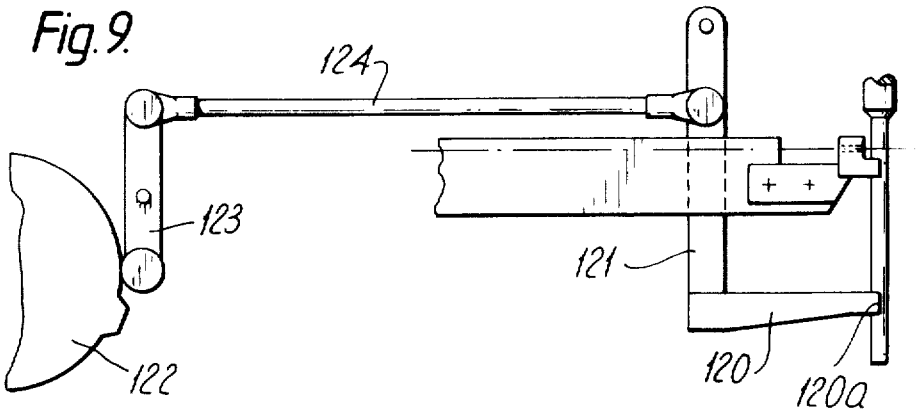
Fig.10b.
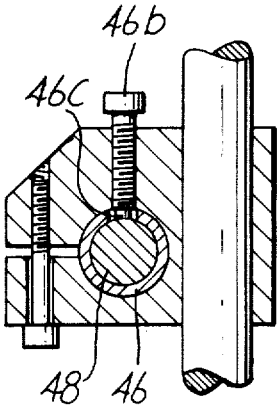
Fig.10a.
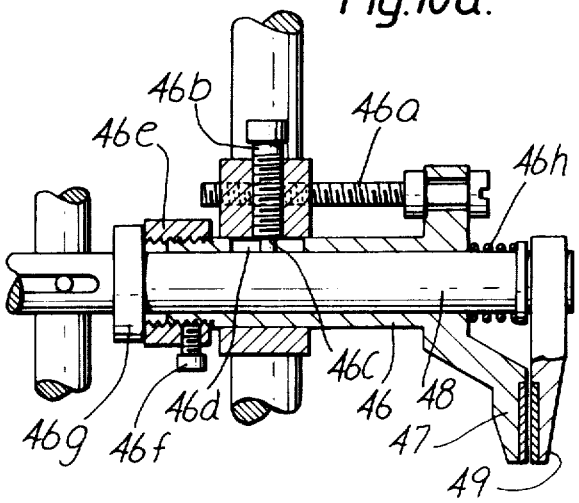

COIL WINDING MACHINE

BACKGROUND OF THE INVENTION

The object of the present invention is a coil winding machine for winding coils for electronic use, particularly coils without support, or bare or insulated wire.

The purpose of the present invention is to realize a coil winding machine of the aforementioned type, having a high flexibility of use for particularly, but not exclusively:

determining the number of coil turns, or of turn fractions, or determining the final positioning of the terminals at the start and at the end of the winding;

the fully automatic feeding of the wire to the winding spindle, determining exactly the length of the terminals at the start and at the end of the winding;

determining the pitch of the turns;

determining the coil diameter, both with very thin wires and with relatively thick and rigid wires.

SUMMARY OF THE INVENTION

All these results, and others which will appear more evident from the following description, are obtained with a coil winding machine structure according to the invention, which is essentially characterized in that it comprises:

a main driving shaft, driven at a constant speed of rotation by a respective driving motor;

a set of control cams, keyed onto said main shaft;

a rotary spindle, on which the coil is formed, which is caused to rotate—for a predetermined number of turns or turn fractions—by a sector gear, through a toothed gearing comprising at least one pinion, keyed onto the spindle shaft, and a main gearwheel, said sector gear being oscillated by a first cam of said set of cams, while said pinion and said spindle shaft are mounted so as to move parallely to themselves, along an arc concentric with the rotation axis of said main gearwheel;

a wireguide for moving forward and positioning the leading end of the wire in respect of the spindle, at the start of the winding, the forward movement of the wireguide being controlled by a second cam of said set of cams and the leading end of the wire being dragged by the wireguide through the action of positive control check means associated to said wireguide;

shears for cutting the wire at the end of the winding, controlled by a third cam of said set of cams and the position of which can be adjusted in respect of the spindle and of the wireguide through end adjustment means to predetermine the length of the terminals at the start and at the end of the winding; and means for predetermining the turns distribution law.

BRIEF DESCRIPTION OF THE DRAWINGS

Further characteristics and advantages of the coil winding machine according to the present invention will become apparent from the following description of some preferred embodiments thereof given by mere way of example with reference to the accompanying drawings, in which:

FIG. 8 shows a detail of the wireguide of FIG. 2, in cooperation with a winding spindle for relatively thick wires;

FIG. 8*a* shows the winding spindle alone, rotated by 90° in respect of the position of FIG. 8;

FIG. 9 is a side view of a differt winding spindle, with related support device for winding coils with a very small inside diameter and;

FIGS. 10*a* and 10*b* are, respectively, an axial section view and a cross-section view, of the wire cutting unit with micrometric adjustment of the position.

DESCRIPTION OF THE PREFERRED EMBODIMENT

Figure 1:
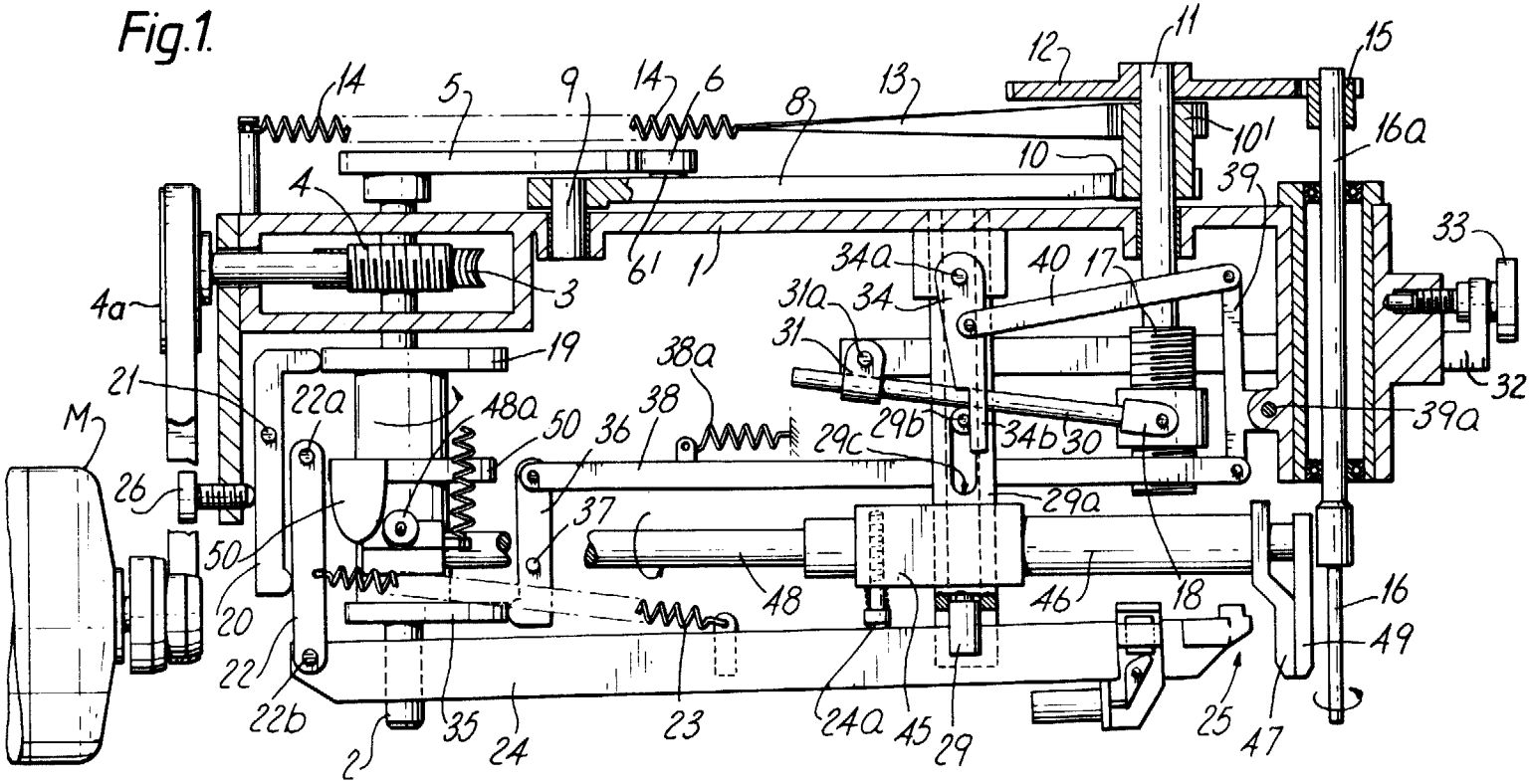
FIG. 1 is a general scheme of the machine, the component parts of which are shown—for a better understanding of its operation—in a single vertical plane, even if this does not fully correspond to structural reality.

FIG. 1 shows the stationary frame 1 of the machine, on which is rotatably mounted the main camshaft 2, operated by an electric motor M through the gearwheel 3 and the worm screw 4.

Figure 4A:
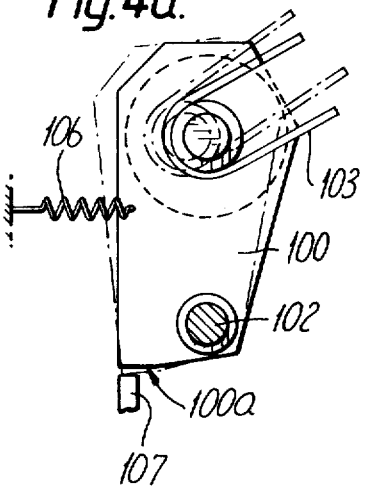
FIGS. 4*a*, 4*b* and 4*c* are, respectively, a front view and side views in two different working positions, of the driving motor unit.
Figure 4C:
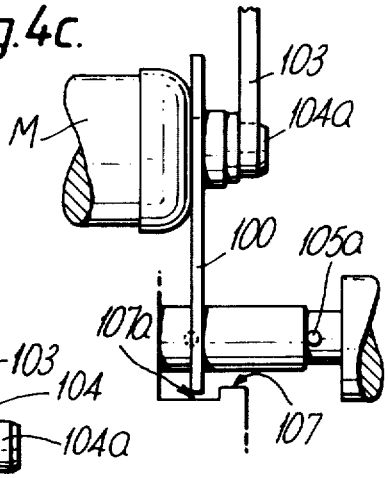
Figure 4B:
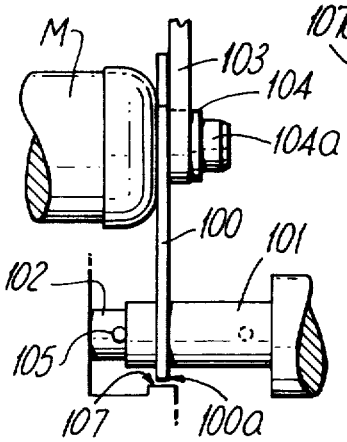

The motor M, as clearly shown in FIGS. 4*a*, 4*b* and 4*c*, is mounted on a support bracket 100, which is fixed to a sleeve 101 rotating about a pivot 102. In the position of FIG. 4*b*—which corresponds to the position shown with continuous lines in FIG. 4*a*—the driving belt 103, which drives the pulley 4*a* of the worm screw 4, engages the pulley 104 having a greater diameter than the pulley 104*a*, the bracket 100, with its sleeve 101, is shifted to the right (in respect of the drawing) and is held in such position by the cotter pin 105. A spring 106 tends to shift the support bracket 100, and thus the motor M, counterclockwise as seen in FIG. 4*a*, so as to keep the belt 103 under tension.

When wishing to operate the machine at a lower speed, the cotter pin 105 is drawn out, the sleeve 101 is shifted to the left (in respect of the drawing, as shown in FIG. 4*c*), the cotter pin is again inserted in the position 105*a*, and the belt is shifted onto the pulley 104*a* of smaller diameter.

It is important to note that, in each of the two positions of FIGS. 4*b* and 4*c*, the spring 106 performs also a function of safety for the motor M, in the sense that it allows the slipping of the pulleys 104 or 104*a* in respect of the belt 103, in the event that the mechanism of the coil winder should, for one reason or the other, jam or stick.

This function of safety is favored by the structure of pulleys 104, 104*a*, which have their end part beveled and slightly conical, and their surface polished, for example chromed. Thanks to this configuration, when the belt 103 is checked by the mechanism of the coil winder, or even jammed, it first of all slips and then drops from the pulley.

While the motor M is thus free to rotate, the bracket 100 briefly oscillates about the pivot 102 and bears with its lower edge 100*a* against either one of the two teeth 107, 107*a*. In both positions of the bracket 100 (FIG. 4*b* or 4*c*) such teeth are very close to the edge 100*a*, so as to prevent an exceedingly wide oscillation of the bracket 100 when the belt 103 is released. Furthermore, the tooth 107 is at a higher level than the tooth 107*a*, so as to stop the oscillation of the bracket 100—in the position of FIG. 4*b*—before the belt 103, dropping from the pulley 104, may engage the pulley 104*a*.

On the shaft 2 is fixedly mounted the cam 5, which acts with its contour on the roller 6 carried by a pin 6' projecting from the circular sector 8; this latter is pivoted at 9 and is subjected, by the action of the cam 5, to a reciprocating rotary oscillation which is transmitted, through the ring gear 8', to the pinion 10 keyed on the shaft 11, which is rotatably mounted on the frame 1.

The working stroke of the sector 8, and thus of the spindle 16, does not correspond to the forward motion caused by the action of the cam 5 on the roller 6, but rather to the reverse motion caused by the return action of the spring 14. Consequently, the working stroke of the sector 8 extends from a fixed starting point—end of stroke of the roller 6, corresponding to its contact with the circle arc A-B of the cam 5, as shown in FIG. 5—to an adjustable end point, corresponding to the stopping of the sector 8 against the adjustable setscrew 7.

Figure 5:
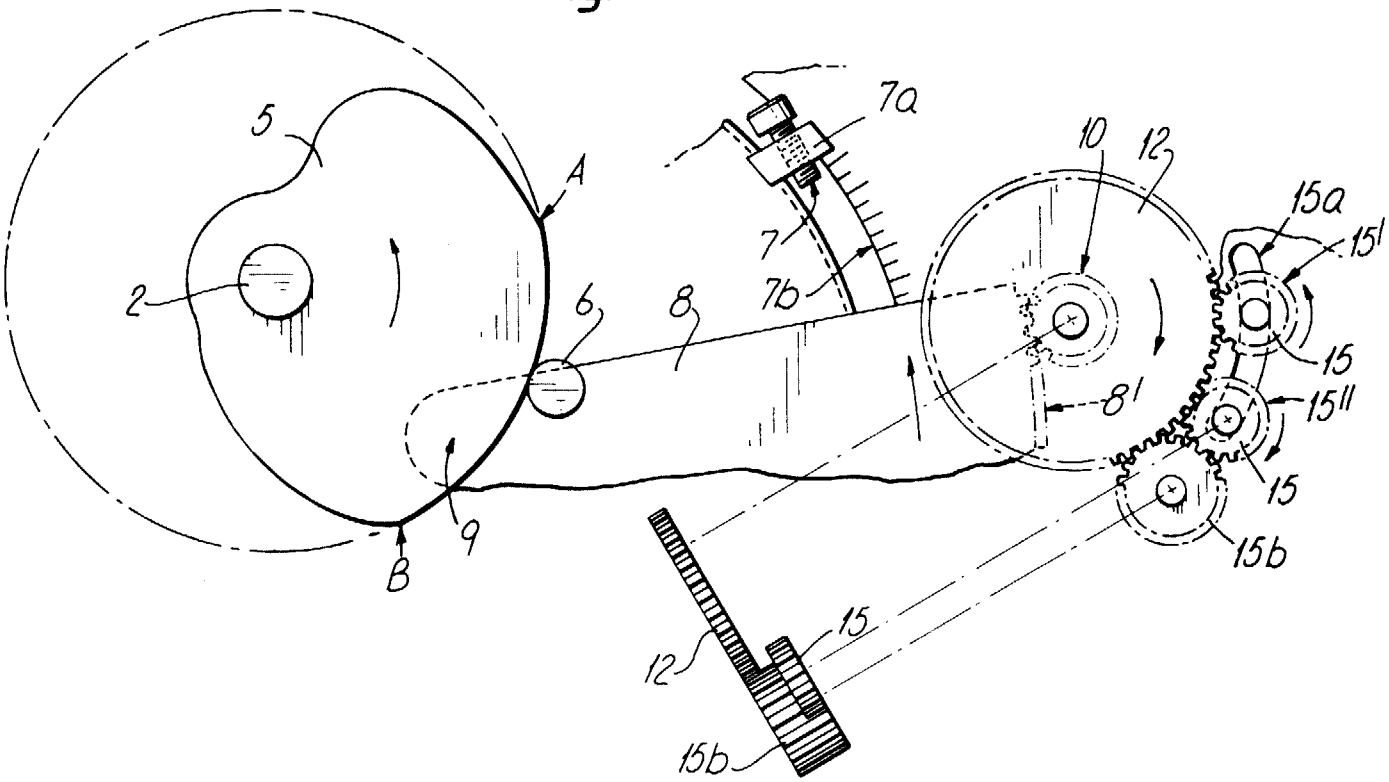
FIG. 5 is a partial schematic top plan view of the wireguide control unit.

As is clearly shown in FIG. 5, the stop consists of a micrometer screw which screws into a slider 7*a*, which is slidable along a graduated guide 7*b* which is arc-shaped, the center of the arc being the pivot 9 of the oscillating sector 8. A first rough adjustment of the stop position of the sector 8 is carried out by shifting the slider 7*a* along the guide 7*b*, while the final micrometric adjustment is then carried out by means of the screw 7.

The oscillation amplitude of the sector 8—delimited by the position of the stop 7, in the precise manner heretofore described—determines, as easily understood, through the toothed gearing 12, 15, the number of turns or turn fractions performed by the spindle 16, thereby determining not only the number of turns of the coil to be formed, but also the final mutual angular position of the respective terminals.

In practice, the notches of the graduation impressed on the guide 7*b* allow a rough adjustment of the turns of the coil to be formed, while the screw 7 allows one to obtain a precision adjustment, up to even determining the angular position of the terminals. The pinion 10 is formed on a drum-shaped body 10' onto which winds a flexible strap 13, kept under tension by a spring 14. A gearwheel 12, keyed in turn on the shaft 11, meshes with a further pinion 15 which is fixed on the shaft 16*a* of the winding spindle 16.

As is also clearly shown in FIG. 5, the pinion 15—under normal conditions of use—meshes directly with the toothing of the gearwheel 12 (position 15') in order to form coils having turns wound anticlockwise (seen from above, as in FIG. 5). In some cases, however, it is required to form coils wound in the opposite sense (clockwise, in FIG. 5). In this case, the pinion 15 and the shaft 16*a* are shifted along the slot 15*a*—which is arc-shaped the center of the arc being the axis of the shaft 11—towards the position 15'' wherein the pinion 15 is furthermore shifted upward (as outlined in the lower part of FIG. 5) to disengage from the toothing of the gearwheel 12 and engage with the idle gear 15*b*, which is in turn engaged with the gearwheel 12 and through which the reversal of rotation takes place.

The shifting of the winding spindle 16 from position 15' to position 15'', favors:

both the correct positioning of the spindle on one side or the other of the wire alignment (determined by the position of the wireguide), according to the direction of rotation, and the correct positioning (through shifting along the slot 15*a*, in intermediate positions between the positions 15' and 15'') of the spindle itself, exactly tangent to said wire alignment, whatever the diameter of the spindle, or rather the diameter of the coil to be formed.

Besides the cam 5, also the cam 19 is keyed onto the shaft 2, said cam 19 acting with its contour on the end of one of the two arms of a lever 20, fulcrumed at 21. The end of the other arm of the lever 20 acts at an intermediate point on a second lever 22, one end of which is pivoted to a fixed point 22*a* and the other end 22*b* of which carries, pivoted thereto, the arm 24 of the wireguide 25, described hereinafter. A spring 23, extending between the lever 22 and the arm 24, tends:

on the one hand, to pull the arm 24 upward, against the adjustable stop 24*a*, consisting of a micrometer screw the position of which determines the upper starting position of the coil to be formed; and on the other hand, to simultaneously push the lever 22 against the lever 20, and this latter against the fixed stop 26, which is in turn adjustable.

The contour of the cam 19 is adapted to impart, through the levers 20 and 22, a forward movement and—with the cooperation of the spring 23—a backward movement to the wireguide 25.

As shown in detail in FIG. 8, on the end of the wireguide 25 close to the spindle 16 there is mounted a clamp 110 provided with a pair of small teeth 110*a*; between said teeth and an opposite retaining surface 111 there slides the wire F to be fed. By means of a two-armed lever 112, articulated at 113, the pneumatic cylinder 114 is in a position to press the clamp 110 against the surface 111, thereby clamping the wire F. In this manner, immediately before the wireguide 25 is moved forward, so as to bring the starting end of the wire F into contact with the spindle 16, the cylinder 114 is operated and the wire F becomes locked on the wireguide; as the wireguide 25 moves forward, the wire F is thus dragged forward. In this advanced position—in which the wireguide is held throughout the coil winding operation—the cylinder 114 is then retracted in order to release the wire F, which is thus free to advance drawn by the actual spindle 16 which is rotating.

In the event of having to wind wires of larger diameter, which are relatively stiff, the hooking of the wire F onto the spindle 16 takes place—as shown in both FIGS. 8 and 8*a*—by engagement of the starting end of the wire F between the side of the spindle 16 and the pin 16*b*, which is fixed and parallel to the spindle itself. The space between the side of the spindle and the pin 16*b* is such that the wire F remains hooked therebetween without any other means. This hooking is also facilitated by the fact that—as stated with reference to FIG. 5—the side of the spindle 16 is aligned exactly tangent to the wire trajectory, through adjustment of the spindle position along the slot 15*a*.

In cooperation with the clamping device of FIGS. 8, 8*a*, there operates a device for locking the push rod 29 in a position close to the end of its upstroke: such device comprises a lever 34, pivoted at the top to a fixed point 34*a* and comprising at its lower end a tooth 34*b* which is adapted to engage the roller 29*b* (FIG. 1).

The lever 34 is operated by a third cam 35—in turn keyed onto the shaft 2—through the lever 36 pivoted at 37, the tie rod 38 on which acts a return spring 38*a*, the lever 39 pivoted at 39*a*, and the rod 40. When, after a coil has been formed, the wireguide 25 is returned upwards, followed by the rollers 29*b*, this latter first of all meets and then stops against the tooth 34*b*. As soon as the spindle 16 has moved to correct position for starting the winding and the wireguide has in turn correctly positioned the starting end of the wire in respect of the spindle, the lever 34 is caused to oscillate and the tooth 34*b* frees the roller 29*b*; this latter trips upward through the final part of its upstroke, so that the wireguide 25 can lead the starting end of the wire into engagement between the spindle 16 and the pin 16*b*.

The wireguide 25, besides being given a forward movement controlled by the cam 19, is also given a downward movement (and subsequently an upward movement, always under the action of the spring 23). For this purpose, onto the lower end of the shaft 11 there is further keyed a screw 17, the outer thread of which cooperates with the internal thread of a sleeve 18 which is axially slidable but not rotatable; in this manner, during the alternate rotation of the shaft 11, the sleeve 18 may alternately move down and up along the screw 17.

A lever 30 is pivoted at one end to the sleeve 18, while at its other end it slides within a bracket 31 pivoted in 31*a* at the end of an adjustment rod 32. The rod 32 can be fixed to an adjusted position by means of a micrometer screw 33.

Within the fixed vertical guide 29*a* there slides the push rod 29, to an intermediate point of which is anchored the roller 29*b* projecting outwardly of the guide 29*a* through a window 29*c*. An intermediate point of the lever 30 bears on the roller 29*b* to control the downstroke of the push rod 29. The upstroke of the push rod 29 is then determined by the thrust of the wireguide 25 under the return action of the spring 23.

According to whether (through adjustment of the position of the rod 32) the bracket 31 finds itself nearer to or farther from the roller 29*b*, the downward movement of the sleeve 18 is transmitted through the lever 30 to the roller 29*b*—and consequently to the push rod 29 and hence to the wireguide 25—to a greater or lesser extent, so as to thereby determine the pitch of the coil turns or, rather, the mutual spacing of the turns one from the other.

Figure 3A:
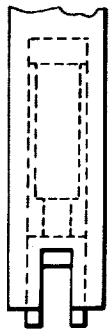
FIGS. 3*a* and 3*b* are, respectively, a side view and a vertical section view rotated by 90°, of the micrometric adjustment device for the wireguide starting position.
Figure 3B:
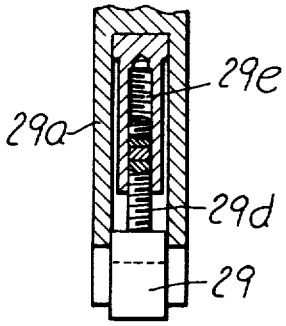

As more clearly shown in FIGS. 3*a* and 3*b*, the lower end of the push rod 29 is fork-shaped in order to correctly embrace and guide the arm 24 of the wireguide. Said fork is fixed to a screw pin 29*d* which screws into a threaded axial hole 29*e* of the push rod 29. When setting the machine, through adjustment of the fork position slightly backward in respect of the fixed stop 24*a*, it is possible to cause the action of the push rod 29 be felt by the arm 24 with a certain delay in respect of the moment at which the coil winding starts. In this manner, one thus performs two or three initial coil turns tightly close one to the other, which is for instance required in order to secure said turns together, simply through the action of a hot air jet, when the wire forming such coils has a thermoplastic coating.

Figure 2:
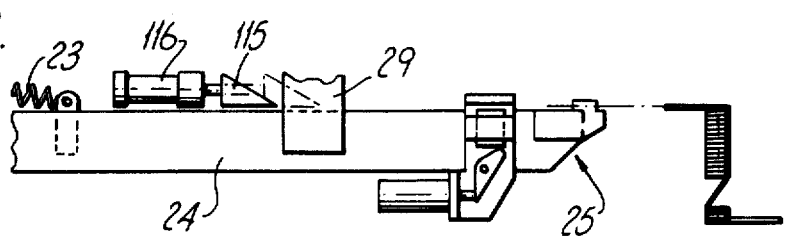
FIG. 2 is a schematic side view of the wireguide unit and of the related control system.

The wireguide structure is completed by the device shown in FIG. 2. Such device comprises a wedge 115 controlled by a cylinder 116, both being mounted on the arm 24. When the wedge 115, normally inactive, is moved forward to the position indicated with dashed lines in FIG. 2, it places itself between the surface of the arm 24 and the fork of the push rod 29. In this way, the wedge 115 abruptly shifts the arm 24 away from the push rod, causing the formation of a lengthened turn (as shown at the right of FIG. 2), which is adapted to separate—in cases where it may be desirable—a first group of coil turns from a second group which is formed subsequently.

On the block 45, fixed to the frame 1, there is mounted axially movably the sleeve 46, which can be fixed in a set position in the manner shown in FIGS. 10*a* and 10*b*. At its end closer to the spindle 16, the sleeve 46 carries a first blade 47 for cutting the coil terminals, as better described hereinafter.

Within the sleeve 46 is free to rotate a shaft 48 which carries, also at its end close to the spindle 16, a second cutting blade 49 which is adapted to cooperate with the blade 47. The cutting movement is imparted to the blade 49 by a further control cam 50—in turn fixed to the shaft 2, together with cams 5, 19 and 35—acting on a roller 48*a*, whose pin projects radially from the shaft 48 itself.

FIGS. 10*a* and 10*b* show in detail the mounting system of the two blades 47 and 49. The sleeve 46 is adjustable in position by means of the micrometer screw 46*a*. Since this adjustment allows one to predetermine the distance between the blade 47, namely the wire cutting point, and the spindle 16, it thus allows to determine with considerable precision the terminal length at the end of the coil winding.

The terminal length at the start of the coil winding, which corresponds to the distance between the cutting point, or the blade 47, and the wireguide 25 in a rest position, is predetermined—after setting the position of the blade 47 as heretofore specified—by adjusting the rest position of the wireguide 25 through setting of the micrometer adjusting screw 26, mentioned above.

The sleeve 46, as well as being adjustable in the axial direction, can also be adjusted in the circumferential sense, so as to also set the distance of the blade 47 from the path of the wire F. A screw 46*b* is provided for this purpose, the bottom part of said screw ending with an eccentric pin extension 46*c*; this pin 46*c* engages in an axial slot 46*d* of the sleeve 46. By turning the screw 46*b*, the pin 46*c* moves crosswise and causes the rotation of the sleeve 46 in the desired sense.

The cutting device shown in FIGS. 10*a* and 10*b* further comprises a system for adjusting the mutual pressure between the blades 47 and 49. For this purpose, a ring nut 46*e* screws onto the end of the sleeve 46 opposite the blade 47, and it can be locked in a set position by means of the screw 46*f*. The ring nut 46*e* bears against a collar 46*g* fixed to the shaft 48, so as to push the sleeve 46, and thus the blade 47, against the blade 49, in opposition to the elastic return action of the spring 46*h*.

The coil winding machine according to the present invention comprises moreover the device of FIG. 9, which allows one to work with very thin spindles 16. The requirement has in fact arisen to produce coils with a very small winding diameter, adapted to be wound on spindles having a diameter of about 1 mm. In this case the spindle is not strong enough—especially if the coil is relatively long and if the wire to be wound has a section of the same order of magnitude as the wireguide—to bear the tension of the feed wire F and is thus inclined to bend under such tension. To avoid this drawback, a support arm 120 is provided—as shown in FIG. 9—having a cradle-shaped end 120*a* which supports the lower end of the spindle during winding. At the end of the winding stage and in order to discharge the finished coil, the arm 120 is moved away from the spindle 16 by oscillation of the rod 121 supporting said arm, under the control of the cam 122—in turn keyed onto the main shaft 2 together with cams 5, 19, 35, 50, though not shown in FIG. 1—and by means of the lever 123 and of the tie rod 124.

Figure 6A:
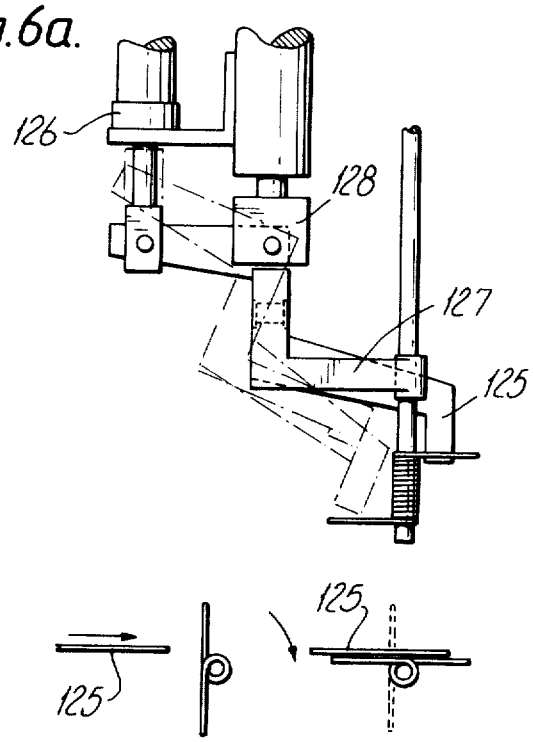
FIGS. 6*a* and 6*b* are elevational views, in two positions rotated by 90° from each other, of the positive unloading device of the finished coils.
Figure 6B:
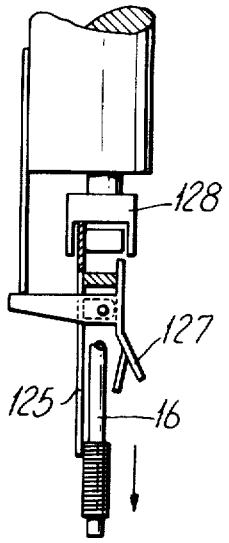

FIGS. 6*a* and 6*b* show a device for carrying out the positive discharge of the finished coils. It has in fact been noticed that, particularly with very thin coils—formed on a thin spindle, as in the case described with reference to FIG. 9—or with coils wound on spindles which are not circular, but for instance square, the extraction of the finished coil from the spindle does not always take place in a correct manner, that is, by merely dropping through its own weight or by an air jet. The device of FIGS. 6*a* and 6*b* therefore comprises an arm 125 which, by oscillating under the control of the cylinder 126, comes to rest against at least one coil terminal and sets the same in a pre-established direction (as clearly shown in the diagram at the bottom of FIG. 6*a*, which obviously refers to the case of using a circular spindle, wherein the entire coil rotates sliding around the spindle). Once it has thus been set, the terminal can easily be grasped by the forked gripper 127, which moves down under the action of the cylinder 128 and forces the terminal downward—obviously together with the coil—drawing it off the spindle 16.

Figure 7A:
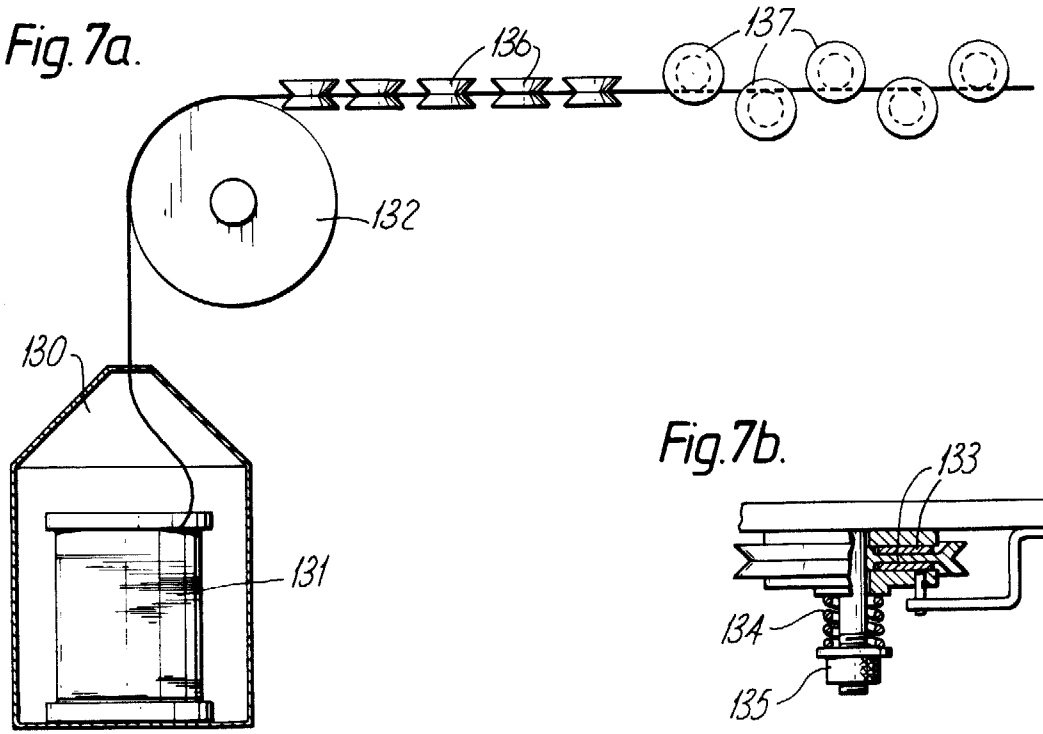
FIGS. 7*a* and 7*b* are, respectively, a side view and a partially sectional plan view, of a wire feeding and tensioning device.
Figure 7B:
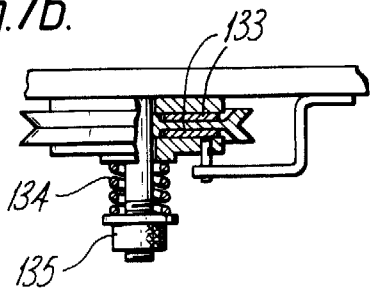

Finally FIGS. 7*a* and 7*b* show the wire feeding device. This latter comprises first of all a cage 130, containing the spool 131, from which the wire unwinds in defile. The wire unwinding from the spool 131 winds first of all onto a friction pulley 132. The friction is obtained through a pair of sliding blocks 133, whose pressure on the pulley 132 is imparted by the spring 134 and adjusted by means of the ring nut 135.

To guarantee a perfect tensioning of the wire, this latter is wound by one or more turns onto the pulley 132, so that no slipping of the wire on the pulley may take place. On the other hand, to assure the perfect straightening of the wire before it reaches the winding spindle, there are provided two sets of guide rollers 136 and 137, which perform a straightening action in two perpendicular planes, as seen in the drawing.

I claim:

1. A coil winding machine for winding unsupported wire coils, comprising a main driving shaft adapted to be driven in rotation by a motor, a set of control cams on said main shaft, a rotary spindle on which the coil is formed when the spindle rotates, means for rotating the spindle, comprising a sector gear and a toothed gearing comprising at least one pinion on the spindle shaft, and a main gearwheel, said sector gear being oscillated by a first cam of said set of cams, means mounting said pinion and said spindle shaft for movement parallel to themselves, along an arc concentric with the rotation axis of said main gearwheel, a wireguide for feeding and distributing the wire being wound, said wireguide being also adapted to move forward and position the leading end of the wire in respect of the spindle, at the start of the winding, the forward movement of the wireguide being controlled by a second cam of said set of cams and the leading end of the wire being dragged by the wireguide by releasable wire gripping means on said wireguide, power means for actuating said wire gripping means, shears for cutting the wire at the end of the winding, controlled by a third cam of said set of cams and the position of which can be adjusted in respect of the spindle and of the wireguide through end adjustment means allowing to determine the length of the terminals at the start and at the end of the winding, and means for predetermining the distribution of the turns in the coil to be formed.

2. A coil winding machine as in claim 1, wherein a supplementary gear is provided for reversing the direction of rotation of the winding spindle, said gear meshing with said main gearwheel and being mounted idle on a fixed axis arranged close to one end of said circle arc along which the spindle moves, the pinion of the spindle being further movable along its axis in order to disengage from the toothing of the main gearwheel and move into engagement only with the toothing of the supplementary gear.

3. A coil winding machine as in claim 1, wherein the working stroke of said oscillating sector gear extends from a fixed starting point determined by the contour of said first cam, to a positionally adjustable stop fixed to the machine frame.

4. A coil winding machine as in claim 3, wherein said adjustable stop consists of an adjusting micrometer screw carried by a slider, which is slidable and adjustable in position along an arc-shaped guide having its center on the rotation center of said oscillating sector gear.

5. A coil winding machine as in claim 1, wherein the wireguide forward stroke extends between a starting position, determined by the adjustable stop, and an end of stroke position, determined by the contour of said second cam, the length of said stroke corresponding to the sum of the lengths of the terminals at the start and at the end of the winding.

6. A coil winding machine as in claim 5, wherein the wireguide forward movement is controlled by said second cam through a two-armed lever, on one end of which acts the second cam, and the other end of which acts on the wireguide, said two-armed lever being oscillated by the cam between a first position in which it is resting, under the pressure of spring means, on said adjustable stop, in correspondence with the wireguide start of stroke position, and a second position directly determined by the cam contour in correspondence with the wireguide end of stroke position.

7. A coil winding machine as in claim 6, wherein said adjustable stop consists of a micrometer adjustment screw.

8. A coil winding machine as in claim 1, wherein on the wireguide there is a clamp for positively retaining the wire, said clamp being controlled by pneumatically operating means.

9. A coil winding machine as in claim 8, wherein said clamp comprises a smooth surface, along which slides the wire, and a double-toothed block pressed against said smooth surface, in order to clamp the wire, by said pneumatically operating means.

10. A coil winding machine as in claim 1 wherein said cutting shears, which can be set at an intermediate position of the wireguide forward path, separate the total length of wire running between the spindle and the wireguide, at the end of each winding operation, in a first stretch, running between the shears and the spindle, which forms the end of winding terminal, and in a second stretch, running between the shears and the wireguide, which forms the starting terminal of the next winding.

11. A coil winding machine as in claim 1, wherein said cutting shears consist of a first blade, mounted radially projecting from a sleeve sliding along an axis parallel to the wire forward path and adapted to be set in an adjusted position, and of a second blade, mounted radially projecting from a shaft rotating within said sleeve, and means to keep the blades in tight mutual contact.

12. A coil winding machine as in claim 11, wherein said means for keeping the blades in mutual contact comprises an adjusting ring nut interposed between the sleeve and a shoulder of the shaft, said ring nut being adapted to draw the two blades one close to the other against the action of a counter spring interposed between said blades.

13. A coil winding machine as in claim 12, wherein the sleeve and shaft unit is mounted also angularly adjustable, by rotation about its own axis, under the control of a pin forming the eccentric extension of an adjusting screw, this latter being mounted radially in respect of the sleeve and engaging in an axial slot of said sleeve.

14. A coil winding machine as in claim 1, wherein the means for determining the distribution of the turns comprise, on the one hand, a worm screw forming the extension of the shaft of said main gearwheel and an internally threaded sleeve which is slidable but not rotatable on said screw, an operating lever pivoted on said sleeve, and on the other hand, a bracket adjustable in position and carrying slidably thereon the other end of said operating lever, an intermediate point of this latter engaging with a push rod which controls the progressive movement of the wireguide in a direction parallel to the spindle axis.

15. A coil winding machine as in claim 14, wherein said bracket is carried at the end of a support rod which is movable and adjustable in position by means of a micrometer adjusting screw.

16. A coil winding machine as in claim 15 wherein the end of the push rod resting on the wireguide and controlling its movement parallel to the spindle, is adjustable in position in respect of the rod of said push rod controlled by said operating lever.

17. A coil winding machine as in claim 16, wherein the end of the push rod acting on the wireguide is fork-shaped and embraces the wireguide itself.

18. A coil winding machine as in claim 14, further comprising a tooth for stopping the backward stroke of the push rod, said tooth acting close to the end of said backward stroke and being releasable after the leading end of the wire has been led to a position in which winding starts, such stop tooth being controlled by a fourth cam of said set of control cams.

19. A coil winding machine as in claim 17, and a spacer adapted to be interposed between the push rod control end and the wireguide arm.

20. A coil winding machine as in claim 19, wherein said spacer consists of a wedge mounted slidably on the wireguide arm and controlled by pneumatic operating means.

21. A coil winding machine as in claim 1, further comprising a retaining pin fixed to the spindle, parallel thereto and spaced therefrom, there being a space between said pin and the spindle for the leading end of the winding wire to be engaged and held therebetween.

22. A coil winding machine as in claim 1, wherein the spindle, which is supported at its upper end by the respective support shaft, rests with its free bottom end in a cradle, carried by a stiff support arm which supports the cradle on the side where the winding wire feeding tension takes place.

23. A coil winding machine as in claim 22, wherein said support arm for the cradle is tiltable.

24. A coil winding machine as in claim 1, wherein a fork-shaped arm is disposed to the side of the spindle, said arm being adapted to perform a downward movement by which, by bearing on one of the terminals of a finished coil, it discharges this latter from the spindle.

25. A coil winding machine as in claim 24, wherein a flat oscillating arm is provided in association with said fork-shaped arm, said oscillating arm being adapted to engage laterally at least one of the terminals of a finished coil, in order to position it according to a preestablished alignment by rotating said coil on the spindle.

26. A coil winding machine as in claim 1, wherein the driving motor is mounted on an oscillating bracket and carries at least one pulley on which slides a belt driving the machine, said belt being kept under tension by spring means acting on said oscillating bracket.

27. A coil winding machine as in claim 26, wherein said pulley is cylindrical and has a conically beveled free end.

28. A coil winding machine as in claim 27, wherein the surface of said pulley is polished.

29. A coil winding machine as in claim 28, wherein two coaxial driving pulleys are provided, having different diameters, the one with smaller diameter being arranged more outwardly in respect of the motor body.

30. A coil winding machine as in claim 29, wherein said oscillating bracket is also slidable on its own oscillation pivot, in order to take up two different working positions for operating respectively one or the other of said pulleys.

31. A coil winding machine as in claim 30, wherein, in each of the two working positions, a stop tooth is provided for limiting the oscillation of the bracket, under the pressure of said spring means, in case the belt should break or drop.

32. A coil winding machine as in claim 1, also comprising means for axially locking said oscillation bracket in each of said two working positions.

33. A coil winding machine as in claim 1, and means to feed the winding wire comprising, downstream of a cage housing a feeding spool from which the wire unwinds in defilé, a transmission sheave and friction means for braking the rotation of said sheave.

34. A coil winding machine as in claim 33, wherein said friction means are adjustable.

35. A coil winding machine as in claim 34, wherein means for straightening the wire are provided downstream of said transmission sheave.

36. A coil winding machine as in claim 35, wherein said wire straightening means consist of two sets of grooved guide rollers, acting on opposite sides of the wire and being respectively aligned in two planes passing through the wire feeding axis at right angles to each other.

* * * * *